United States Patent [19]

Hanson et al.

[11] 4,282,565

[45] Aug. 4, 1981

[54] SEALED, PREFOCUSED MOUNT FOR PLASTIC PAR LAMP

[75] Inventors: James M. Hanson, Euclid; Irving Bradley, Novelty, both of Ohio

[73] Assignee: General Electric Company, Schenectady, N.Y.

[21] Appl. No.: 58,061

[22] Filed: Jul. 16, 1979

[51] Int. Cl.[3] ..... F21V 29/00

[52] U.S. Cl. ..... 362/267; 362/306

[58] Field of Search ..... 362/267, 306

[56] References Cited

U.S. PATENT DOCUMENTS

| | | | |
|---|---|---|---|
| 3,089,951 | 5/1963 | Baldwin | 362/267 |
| 3,137,804 | 6/1964 | Rubens | 362/267 X |
| 3,612,852 | 10/1971 | Bogossian | 362/267 |
| 3,720,824 | 3/1973 | Callahan | 362/267 |
| 3,886,349 | 5/1975 | Arai | 362/306 |
| 4,128,864 | 12/1978 | Brusse et al. | 362/306 |
| 4,190,976 | 3/1980 | Hurt | 362/267 X |

*Primary Examiner*—Peter A. Nelson

*Attorney, Agent, or Firm*—John F. McDevitt; Lawrence R. Kempton; Philip L. Schlamp

[57] ABSTRACT

An improved sealing means is provided for a sealed prefocused light source mount for a parabolic aluminized reflector (PAR) lamp and, in particular, to improved leak-proof sealing means for an all-plastic PAR lamp or a PAR lamp comprising a plastic reflector. The improved mount construction utilizes a plastic block having mating parts which define a cavity from which lead wires extend and which is filled with an elastomeric polymer providing both a leak-proof seal around the lead wires as well as a more reliable barrier to moisture leakage through the mount assembly.

8 Claims, 3 Drawing Figures

SEALED, PREFOCUSED MOUNT FOR PLASTIC PAR LAMP

RELATED PATENT APPLICATION

U.S. patent application Ser. No. 921,490 filed in the name of Vincent Vodicka on July 3, 1978, and assigned to the present assignee, describes a sealed prefocused mount construction for plastic PAR lamps that utilizes a plastic block member having at least two lead wires extending therefrom as a means for prefocusing the light source in said lamps. More particularly, said plastic block mount is of a split-half construction to permit insertion of the lead wires into channels formed in each half and thereafter filling the channels with an elastomeric polymer for joinder of the halves together to provide a sealed unit. Moisture leakage occurs in this mount assembly from lack of registration between the two mount halves and can lead to improper focusing of the light source when subsequently joined to the reflector. A more leak-proof mount construction is thereby desirable which can more reliably fix the position of the light source at the focus point of the reflector.

SUMMARY OF THE INVENTION

It is therefore an important object of the invention to provide a more leak-proof prefocused mount for plastic PAR lamps.

Another important object of the invention is to provide an improved mount construction for prefocusing the light source in a plastic reflector in a PAR lamp.

Still another important object of the present invention is to provide an improved method for assembling a prefocused light source mount for a plastic reflector lamp as well as thereafter assembling said mount construction to the reflector member.

These and other objects of the present invention are achieved using a plastic block as the prefocused mount member wherein said block comprises mating parts which define the cavity for receiving the lead wires, said mating parts comprising an inner container member defining said cavity which is fitted into an outer housing member. Said inner and outer parts of the mount construction are sealed together after assembly of the lead wires in the cavity to form a leak-proof enclosure by having said cavity filled with an elastomeric polymer which provides a leak-proof seal around the lead wires. In a preferred embodiment, the inner container member of the mount assembly has a box-like form which is fitted into an outer box-like housing member and with the box-like members being thereafter sealed together at the periphery of the inner member by ultrasonic welding. The assembled mount construction having at least two electrical leads extending therefrom can thereafter have the light source assembled to the inleads at a position fixed with respect to a locating surface on the mount construction which prefocuses said light source. The assembled mount and light source can thereafter be fitted to reference features of a receptacle molded in the rear outer surface of the reflector member to provide still further positioning of the light source at the focus of said reflector. The preferred light source of the reflector lamp is a tungsten halogen incandescent lamp such as described in U.S. Pat. No. 4,139,794 which is assigned to the present assignee.

DESCRIPTION OF THE PREFERRED EMBODIMENTS

Figure 1:
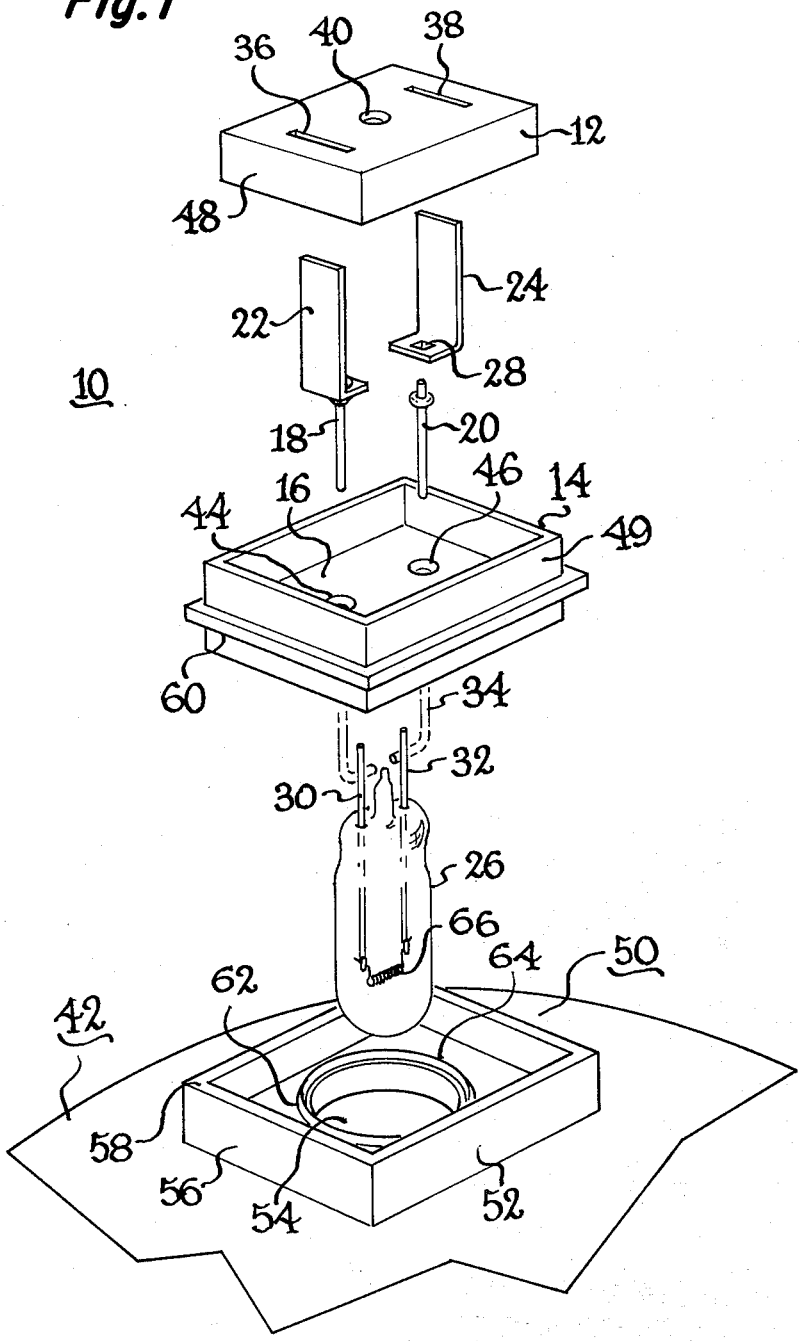
FIG. 1 is a perspective view of an unassembled mount construction according to the present invention which further includes parts of the reflector member to which said mount is finally assembled.

Referring to FIG. 1 there is shown the unassembled parts of a prefocused mount and reflector lamp construction of the present invention. Accordingly, said mount construction 10 comprises an assembly of a plastic inner container member 12 which is fitted into an outer plastic housing member 14 to define an enclosed cavity 16 after being sealed together. A pair of lead wires 18 and 20 are joined to metal lug members 22 and 24, respectively, as electrical connecting means extending from opposite ends of the plastic mount construction and which serve to electrically connect the light source 26 to a suitable power supply (not shown). Each of said lead wires is mechanically joined to the L-shaped metal lug member by insertion into a square shape opening 28 and which is followed by mechanical deformation of the circular lead wire to prevent its rotation thereafter. Said lead wires 18 and 20 can also be joined to lamp inleads 30 and 32, respectively, by conventional crimping or welding preferably after bending 34 to impart added mechanical rigidity. The inner plastic block 12 which defines a cavity for receiving the joined lead wires includes a pair of slotted openings 36 and 38 for exit of the metal lug members along with an entrance opening 40 which permits the cavity to be filled with elastomeric polymer after mating with the outer housing member 14. Sealing means provided in this manner not only provides a leak-proof enclosure from the reflector member 42 after assembly thereto but further provides a leak-proof seal around the lead wires upon filling the channel openings 44 and 46 for said lead wires which lead to the interior of the reflector member. The elastomeric polymer can be injected into the cavity opening after the mating plastic parts have been assembled and preferably bonded together by ultrasonic welding at the periphery 48 of the inner member. The elastomer thus encapsulates the lugs and leads and, when cured, provides an adhesive seal between all surfaces to achieve the desired leak-proof enclosure.

The assembled mount construction 10 is suitably joined to reflector member 42 at raised receptacle means 50 which is disposed on the rear side of said reflector. Accordingly, said receptacle means comprises a box-like member 52 into which the assembled plastic block mount is fitted and which contains a central aperture 54 through which the light source 26 extends after joinder. Wall portions 56 of the receptacle means furnish a support ledge 58 which accomodates the underside surface of a flange 60 extending outwardly from the assembled block mount after joined together as hereinafter described. A circular raised wall 62 which terminates in a peak 64 surrounds the central aperture opening 54 and furnishes the means to ultrasonically bond or otherwise adhesively join the assembled block mount to the receptacle means. The above overall described mount assembly achieves prefocusing of the light source for a reflector lamp in a dual manner for improved alignment of the light source at the focus of said reflector. Specifically, initial prefocusing of said light source is conducted by locating the lamp filament 66 at a predetermined distance from the underside referenced surface or datum plane that is provided by the flange portion 60 of the assembled block mount 10 when said light source is being joined thereto. A final prefocusing of the light source takes place when the assembled block mount and light source is thereafter joined to receptacle means 50 of the reflector member 42. Said final prefocusing step can occur during ultrasonic welding of the assembled block mount and light source unit to the raised wall 62 of the receptacle means as can be better observed by reference to FIG. 2. The ultrasonic weld melts a sufficient portion of the raised wall 62 to enable the underside surface of flange 60 on the assembled block and lamp unit to reset on ledge 58 of the receptacle wall member 52. By such means the ledge 58 serves as a locating surface to establish the position of the light source at the focus of the reflector. Said final bonding of the circular wall portion 62 to the underside facing surface of the assembled block mount further serves to provide a leak-proof seal for the reflector member against the outside environment.

Figure 2:
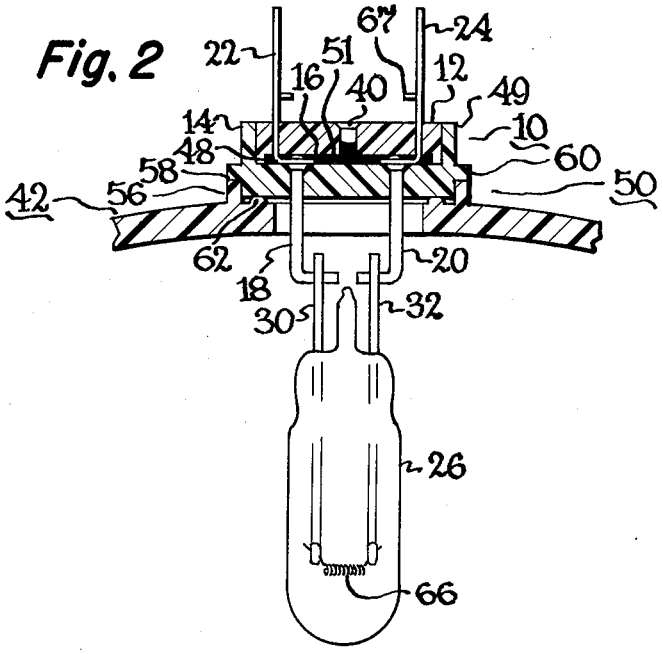
FIG. 2 is a cross sectional view of said mount construction after assembly in the reflector.
Figure 3:
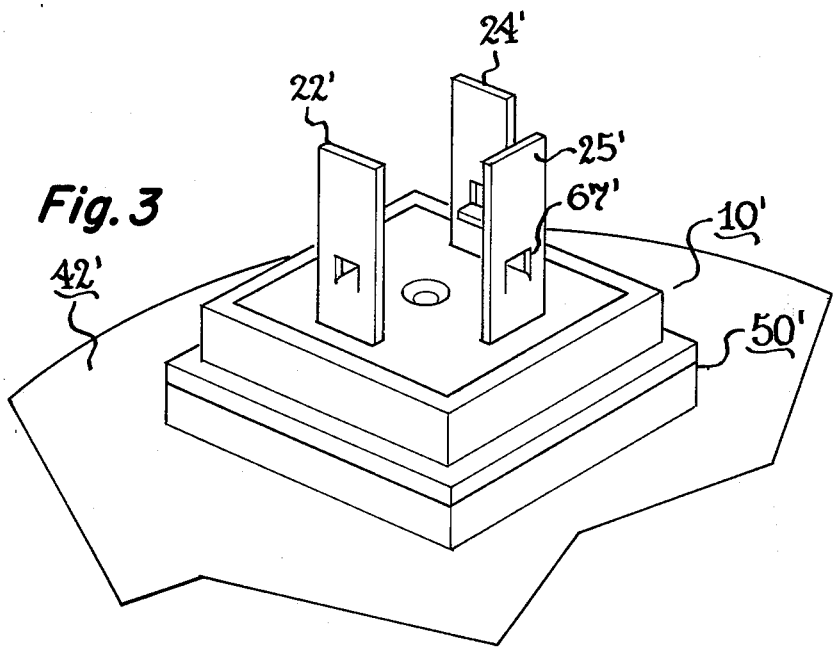
FIG. 3 represents an assembled mount in accordance with the present invention which has three metal lugs extending from the plastic block to permit electrical connection to a multi-filament incandescent lamp lighting source.

In FIG. 2, there is shown a cross section of the assembled block mount and light source unit described above in connection with FIG. 1. Accordingly, said assembled block mount 10 and light source 26 has been ultrasonically bonded to receptacle means 50 of reflector member 42. As can be noted, the pair of electrical leads 18 and 20 are joined to metal lugs 22 and 24 and reside in the enclosed cavity 16 although extending outwardly from the assembled block mount. The cavity 16 is formed by walls 48 of the inner box-like container member 12 which fits within the walls 49 of the outer housing member 14. Aperture opening 40 of said inner container member 12 permits injection of the elastomeric polymer 51 into the enclosed cavity to provide a leak-proof seal for the assembled block mount. As can also be seen, a further leak-proof seal exists between the assembled block mount and the reflector member 42 resulting from a joinder therebetween. Ultrasonic welding of the wall 62 in said receptacle means to the underside surface of the assembled block mount provides a barrier to moisture penetration inside the reflector member which can result from exposure to ambient conditions. Said ultrasonic welding of the assembled block mount to the receptacle means of reflector member 42 further permits lowering of the underside surface of flange portion 60 of said block mount to rest on the surface 58 provided by outer wall 56 of the receptacle member. Mechanical stop means 67 and 67' are also shown in FIGS. 2 and 3, respectively, and which can be provided after assembly of the block mount to the reflector member to limit insertion of the assembled unit into the particular plug-in receptacle being used to supply electrical power to the lamp. Said stop elements can be formed by mechanical perforation of the metal lugs so that the displaced metal serves as protruding tangs or ears for the intended purpose.

Suitable elastomeric polymers for use in accordance with the present invention include silicone rubber compounds such as what is known as RTV, or other elastomeric polymers such as polyurethane. The only requirements of the elastomeric polymer is that, when cured, it adheres to the plastic block and the metals used for the leads and lugs, for example nickel clad iron and brass, respectively, throughout lamp life thus assuring that the seal will be leak-proof. A polycarbonate resin is preferred as the plastic material for the present lamp and mount construction by reason of its thermal and mechanical characteristics for this product application.

FIG. 3 illustrates an assembled mount construction of the present invention having three lug members for electrical connection to a light source utilizing a pair of incandescent filaments. As can be seen, the assembled block mount 10' has the same general configuration above described and can be assembled in the same manner to receptacle means 50' of a plastic reflector member 42'. The three lug members 22', 24', and 25' are electrically connected to said multi-filament incandescent light source, (not shown) for conventional headlamps incorporating both high beam and low beam filaments.

It will be apparent from the foregoing description to those skilled in the art that various modifications can be made in the above described preferred embodiments which is still within the spirit and scope of the present invention. For example, as previously noted, a variety of elastomeric polymers may be utilized providing they fulfill the condition that they adhere to both metal and plastic. Similarly, while said preferred embodiments have been described having a generally rectangular shape in the form of box-like members, other suitable shapes such as cylindrical may be used in providing the desired mount construction. It is also contemplated that suitable light sources include conventional incandescent lamps, tungsten halogen lamps or discharge lamps. It is intended to limit the present invention, therefore, only by the scope of the following claims.

What we claim as new and desire to secure as a Letters Patent of the United States is:

1. In a prefocused light source mount for a reflector lamp to position the light source at the focus point of the reflector comprising at least two lead wires, at least two electrical connecting means joined one each to said lead wires, a plastic block having mating parts defining a cavity for receiving said joined lead wires, an elastomeric polymer in the cavity of said block, and a light source connected to the ends of said lead wires outside said block, the improved sealing means wherein the mating parts of said block comprise an inner container member defining said cavity and fitted into an outer housing member, said inner and outer members being sealed together after assembly to form a leak-proof enclosure, and with said cavity thereafter being filled with said elastomeric polymer to further provide a leak-proof seal around the lead wires.

2. A prefocused light source mount as in claim 1 wherein the inner container member has a box-like form which is fitted into an outer box-like housing member and said box-like members are sealed together at the periphery of the inner member.

3. A prefocused light source mount as in claim 1 wherein the light source is a tungsten-halogen lamp.

4. A prefocused light source mount as in claim 1 wherein the electrical connecting means is a metal lug having a metal inlead mechanically affixed thereto.

5. A prefocused light source mount as in claim 1 wherein the light source is positioned with respect to a locating surface on the mount construction.

6. A reflector lamp having a lens, and a plastic reflector wherein the prefocused mount of claim 1 is sealed to receptacle means on the reflector permitting the light source to be positioned approximately at the focus of said reflector.

7. A reflector lamp as in claim 6 wherein said receptacle means includes a locating surface as the means of positioning the light source at the focus of said reflector.

8. A reflector lamp as in claim 7 wherein the light source is also positioned with respect to a locating surface on the mount construction.

* * * * *